US007235156B2

(12) United States Patent
Baggot

(10) Patent No.: US 7,235,156 B2
(45) **Date of Patent: *Jun. 26, 2007**

(54) METHOD FOR REDUCING NESTING IN PAPER PRODUCTS AND PAPER PRODUCTS FORMED THEREFROM

(75) Inventor: James L. Baggot, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/995,416

(22) Filed: Nov. 27, 2001

(65) Prior Publication Data

US 2003/0106657 A1 Jun. 12, 2003

(51) Int. Cl.
*D21F 11/00* (2006.01)

(52) U.S. Cl. ..... 162/117; 162/109; 162/111; 162/112; 428/156; 428/141; 428/343; 264/284; 156/209; 156/220

(58) Field of Classification Search ..... 162/117, 162/109, 111, 112; 428/156, 141, 343; 264/284; 156/209, 220
See application file for complete search history.

(56) References Cited

U.S. PATENT DOCUMENTS

| | | | |
|---|---|---|---|
| 4,339,088 | A | 7/1982 | Niedermeyer |
| 4,529,480 | A | 7/1985 | Trokhan |
| 4,659,608 | A | 4/1987 | Schulz |
| 4,803,032 | A | 2/1989 | Schulz |
| 5,048,589 | A | 9/1991 | Cook et al. |
| 5,129,988 | A | 7/1992 | Farrington, Jr. |
| 5,399,412 | A | 3/1995 | Sudall et al. |
| 5,436,057 | A | 7/1995 | Schulz |
| 5,494,554 | A | 2/1996 | Edwards et al. |
| 5,510,001 | A | 4/1996 | Hermans et al. |
| 5,573,830 | A | 11/1996 | Schulz |
| 5,591,309 | A | 1/1997 | Rugowski et al. |
| 5,597,639 | A | 1/1997 | Schulz |
| 5,620,776 | A | 4/1997 | Schulz |
| 5,667,636 | A | 9/1997 | Engel et al. |
| 5,874,156 | A | 2/1999 | Schulz |

(Continued)

FOREIGN PATENT DOCUMENTS

| | | |
|---|---|---|
| EP | 0738588 | 10/1996 |

(Continued)

OTHER PUBLICATIONS

PCT Search Report, Sep. 12, 2002.

*Primary Examiner*—Mark Halpern
(74) *Attorney, Agent, or Firm*—Dority & Manning, P.A.

(57) ABSTRACT

A multi-layered paper product that has bridging regions for inhibiting nesting is provided. For example, the paper product can contain a first and second layer that define ridges and valleys. Bridging regions are formed into at least one of the outer surfaces of the layers. In particular, the bridging regions are positioned at an angle of between about 0° to about 180° relative to the ridges and also have a length sufficient to extend between the peaks of at least two of the ridges. The bridging regions can be formed in a variety of ways, such as with an embossing roll that contains embossing elements. Moreover, the bridging regions can also have a variety of shapes, sizes, orientations, and/or patterns.

37 Claims, 10 Drawing Sheets

U.S. PATENT DOCUMENTS

| | | | | |
|---|---|---|---|---|
| 5,965,235 | A | 10/1999 | McGuire et al. | |
| 6,017,417 | A | 1/2000 | Wendt et al. | |
| 6,077,590 | A | 6/2000 | Archer et al. | |
| 6,348,131 | B1 * | 2/2002 | Kershaw et al. | 162/112 |

FOREIGN PATENT DOCUMENTS

| | | |
|---|---|---|
| EP | 1099539 | 5/2001 |

* cited by examiner

METHOD FOR REDUCING NESTING IN PAPER PRODUCTS AND PAPER PRODUCTS FORMED THEREFROM

BACKGROUND OF THE INVENTION

Paper products are commonly formed from pulp fibers, either alone or in combination with other types of fibers. For example, to form a paper web, a dilute aqueous suspension of pulp fibers may be deposited onto a foraminous surface using a headbox. A vacuum device is often located beneath the foraminous surface for removing water away from the web to facilitate web formation. After the web passes over the vacuum device, it is then dried using a conventional drier, such as a through-air dryer.

As a result of a papermaking process, such as described above, the paper web is sometimes formed with an undulating surface that includes multiple ridges and valleys. For example, the foraminous surface on which the pulp fiber suspension is deposited may contain certain features that cause the wet paper web to be formed with ridges and valleys when it passes over the vacuum device. These ridges and valleys can become further defined when the wet web is passed over a dryer that does not utilize compressive forces, such as a through-air dryer.

Although these ridges and valleys can provide many benefits to the resulting paper web, problems sometimes arise when the paper web is incorporated into a paper product. For example, a rolled or stacked paper product containing multiple layers of a paper web having ridges and valleys can possess a certain degree of "nesting". Specifically, "nesting" occurs when the ridges and valleys of one layer are placed adjacent to corresponding ridges and valleys of another layer, which causes the roll (or stack) to become more tightly packed, thereby reducing roll bulk (increasing density) and making the winding of the product less consistent and controllable. For example, referring to FIG. 3, one example of a nested paper product is illustrated.

As such, a need currently exists for a method to inhibit nesting in paper products.

SUMMARY OF THE INVENTION

In accordance with one embodiment of the present invention, a paper product is provided that includes a first layer and a second layer formed from at least one paper web. In some embodiments, the layers of the paper product can form a wound roll, while in other embodiments, the layers can be individually stacked.

In addition, the first and second layers of the paper product have an outer surface that defines ridges and valleys. The outer surface of the first layer is positioned adjacent to the outer surface of the second layer. In order to inhibit nesting, the present invention provides for the use of bridging regions formed into at least one of the outer surfaces of the layers. In particular, the bridging regions are positioned at an angle of between about 0° to about 180° relative to the ridges defined by the outer surface. In one embodiment, for example, the bridging regions are positioned at an angle of about 90° relative to the ridges. Furthermore, the bridging regions also have a length sufficient to extend between the peaks of at least two of the ridges defined by the outer surface.

In accordance with another embodiment of the present invention, a method is provided that includes depositing a furnish containing cellulosic fibers onto a foraminous surface and forming a paper web from the furnish such that the web has a surface that defines ridges and valleys.

Moreover, the method also includes embossing the paper web to form bridging regions into at least one surface of the paper web. For example, in one embodiment, an embossing roll having embossing elements can be utilized to form the bridging regions.

Further, the method also includes incorporating the paper web into at least one layer of a multi-layered paper product such that the surface of the paper web is disposed on the outer surface of the layer. Moreover, the outer surface is then placed adjacent to the outer surface of another layer of the paper product, which also defines ridges and valleys. As a result, the bridging regions can at least partially obstruct the ridges and valleys of one layer from mating with the ridges and valleys of another layer to inhibit nesting.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
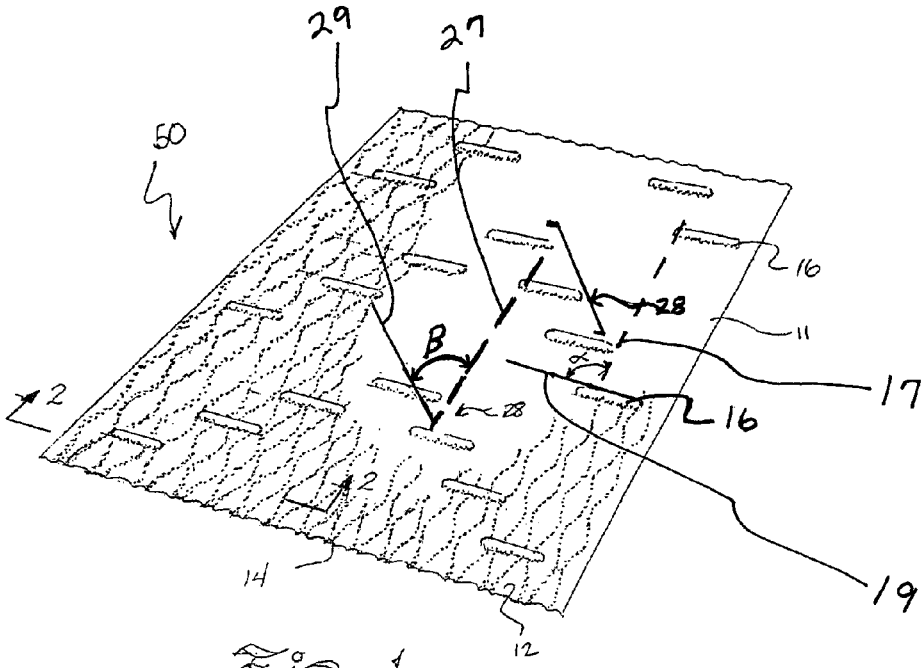
FIG. 1 is a perspective view of a paper web that contains bridging regions in accordance with one embodiment of the present invention.

Repeat use of reference characters in the present specification and drawings is intended to represent the same or analogous features or elements of the invention.

DETAILED DESCRIPTION OF THE REPRESENTATIVE EMBODIMENTS

Reference now will be made in detail to various embodiments of the invention, one or more examples of which are set forth below. Each example is provided by way of explanation, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to a method for reducing the level of "nesting" in a paper product. In particular, "nesting" occurs when the ridges and valleys of one layer are placed adjacent to corresponding ridges and valleys of another layer. For example, when one or more paper webs having ridges and valleys are rolled or placed in a stack to form a paper product, the ridges and valleys of one layer of the paper web(s) mate with the ridges and valleys of another layer of the paper web(s), thereby causing the rolled or stacked paper product to become more tightly packed and thus reducing bulk. In some instances, such as during winding of the paper product, it is desirable to eliminate this bulk reduction to make the process more consistent and controllable. Thus, it has been discovered that by imparting various bridging regions into a surface of the paper web(s), such nesting can be inhibited. For example, the bridging regions formed according to the present invention can have a certain size, shape, orientation, pattern, and the like, which allow them to optimally inhibit the mating of ridges and valleys from one layer of the paper product with another layer of the paper product.

A paper product, such as facial tissue, bath tissue, napkins, paper towels, wipes, napkins, etc., is generally formed according to the present invention with at least one paper web. For example, in one embodiment, the paper product can contain a single-layered paper web formed from a blend of fibers. In another embodiment, the paper product can contain a multi-layered paper (i.e., stratified) web. Furthermore, the paper product can also be a single- or multi-ply product (e.g., more than one paper web), wherein one or more of the plies may contain a paper web formed according to the present invention. Normally, the basis weight of a paper product of the present invention is between about 10 to about 400 grams per square meter (gsm). For instance, tissue products (e.g., facial tissue, bath tissue, etc.) typically have a basis weight less than about 120 gsm, and in some embodiments, between about 10 to about 70 gsm.

Any of a variety of materials can be used to form the paper product of the present invention. For example, the material used to make the paper product can include fibers formed by a variety of pulping processes, such as kraft pulp, sulfite pulp, thermomechanical pulp, etc.

In some embodiments, the pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19".

In some embodiments, hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the paper to increase the wicking ability of the paper web. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, furnishes including recycled fibers may also be utilized. Moreover, some suitable synthetic fibers can be used, such as, but not limited to, hydrophilic synthetic fibers, such as rayon fibers and ethylene vinyl alcohol copolymer fibers, as well as hydrophobic synthetic fibers, such as polyolefin fibers.

In general, a variety of papermaking techniques known in the art can be utilized to form the paper web. For example, papermaking techniques such as, but not limited to, through-drying, creped through-drying, uncreped through-drying, embossing, adhesive creping, wet creping, double creping, wet-pressing, air pressing, as well as other steps, can be utilized in forming the paper web. Some examples of such techniques are disclosed in U.S. Pat. No. 5,048,589 to Cook, et al.; U.S. Pat. No. 5,399,412 to Sudall, et al.; U.S. Pat. No. 5,129,988 to Farrington, Jr.; U.S. Pat. No. 5,494,554 to Edwards, et al.; which are incorporated herein in their entirety by reference thereto for all purposes.

One particular embodiment of the present invention utilizes an uncreped through-drying technique to form the paper web. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; and U.S. Pat. No. 6,017,417 to Wendt, et al., which are incorporated herein in their entirety by reference thereto for all purposes. Uncreped through-drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt.

Figure 4:
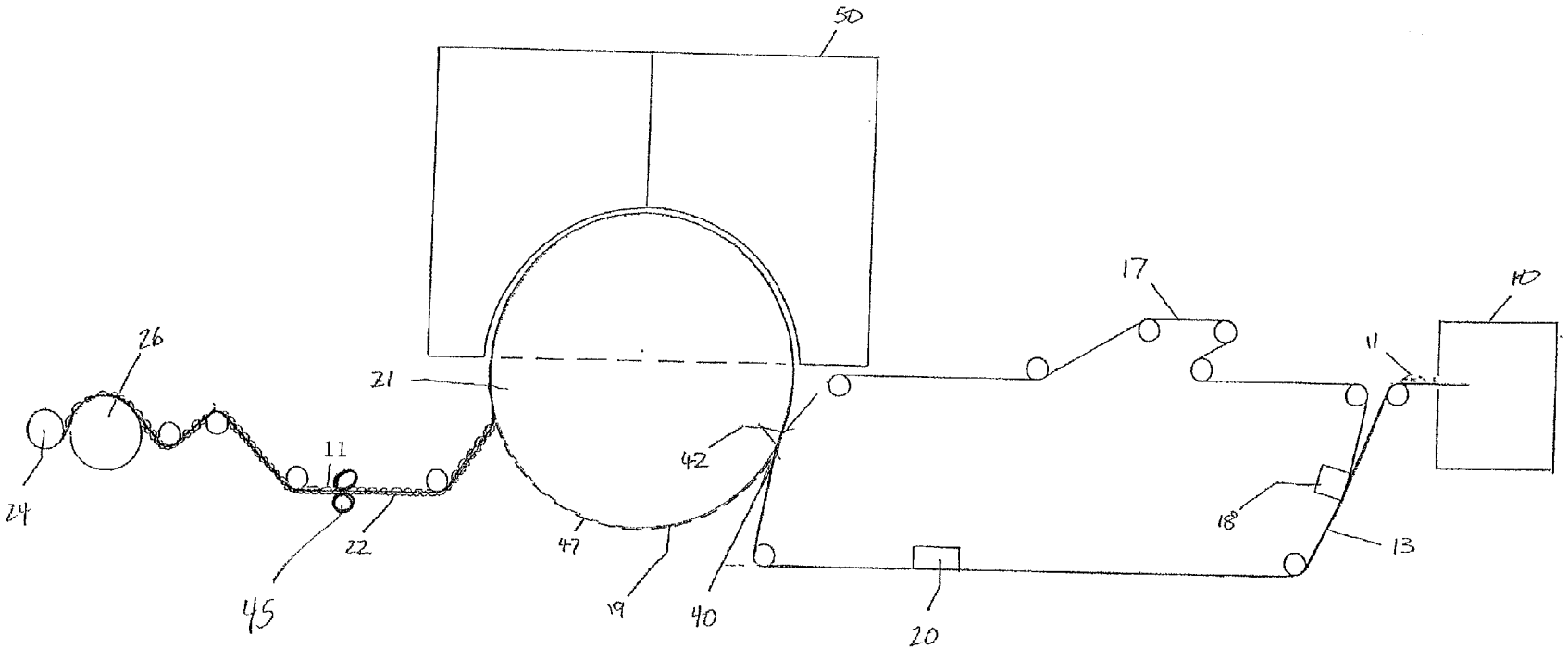
FIG. 4 is a schematic illustration of one embodiment for forming a paper web in accordance with the present invention.

For example, referring to FIG. 4, one embodiment of a papermaking process that can be used in the present invention is illustrated. For simplicity, the various tensioning rolls schematically used to define the several fabric runs are shown but not numbered. As shown, a papermaking headbox 10 can be used to inject or deposit a stream of an aqueous suspension of papermaking fibers onto a forming fabric 13, which serves to support and carry the newly-formed wet web 11 downstream in the process as the web 11 is partially dewatered to a solids consistency of about 10% dry weight. Additional dewatering of the wet web 11 can be carried out, such as by vacuum suction, while the wet web 11 is supported by the forming fabric 13. The headbox 10 may be a conventional headbox or may be a stratified headbox capable of producing a multilayered unitary web. Further, multiple headboxes may be used to create a layered structure, as is known in the art.

The forming fabric 13 can generally be made from any suitable porous material, such as metal wires or polymeric filaments. Suitable fabrics can include, but are not limited to, Albany 84M and 94M available from Albany International of Albany, N.Y.; Asten 856, 866, 892, 959, 937 and Asten Synweve Design 274, available from Asten Forming Fabrics, Inc. of Appleton, Wis. The fabric 13 can also be a woven fabric as taught in U.S. Pat. No. 4,529,480 to Trokhan, which is incorporated herein in its entirety by reference thereto for all purposes. Forming fabrics or felts containing nonwoven base layers may also be useful, including those of Scapa Corporation made with extruded polyurethane foam such as the Spectra Series. Relatively smooth forming fabrics can be used, as well as textured fabrics suitable for imparting texture and basis weight variations to the web. Other suitable fabrics may include Asten 934 and 939, or Lindsey 952-S05 and 2164 fabric from Appleton Mills, Wis.

The wet web 11 is then transferred from the forming fabric 13 to a transfer fabric 17. As used herein, a "transfer fabric" is a fabric that is positioned between the forming section and the drying section of the web manufacturing process. The transfer fabric 17 typically travels at a slower speed than the forming fabric 13 in order to impart increased stretch into the web. The relative speed difference between the two fabrics 13 and 17 can be from 0% to about 80%, particularly greater than about 10%, more particularly from about 10% to about 60%, and most particularly from about 10% to about 40%. This is commonly referred to as "rush" transfer. One useful method of performing rush transfer is taught in U.S. Pat. No. 5,667,636 to Engel et al., which is incorporated herein in its entirety by reference thereto for all purposes.

Transfer may be carried out with the assistance of a vacuum shoe 18 such that the forming fabric 13 and the transfer fabric 17 simultaneously converge and diverge at the leading edge of the vacuum slot. For instance, the vacuum shoe 18 can supply pressure at levels between about 10 to about 25 inches of mercury. The vacuum transfer shoe 18 (negative pressure) can be supplemented or replaced by the use of positive pressure from the opposite side of the web 11 to blow the web 11 onto the next fabric. In some embodiments, other vacuum shoes, such as a vacuum shoe 20, can also be utilized to assist in drawing the fibrous web 11 onto the surface of the transfer fabric 17. During rush transfer, the solids consistency of the fibrous web 11 can vary. For instance, when assisted by the vacuum shoe 18 at vacuum level of about 10 to about 25 inches of mercury, the solids consistency of the web 11 may be up to about 35% dry weight, and particularly between about 15% to about 30% dry weight.

Figure 2:
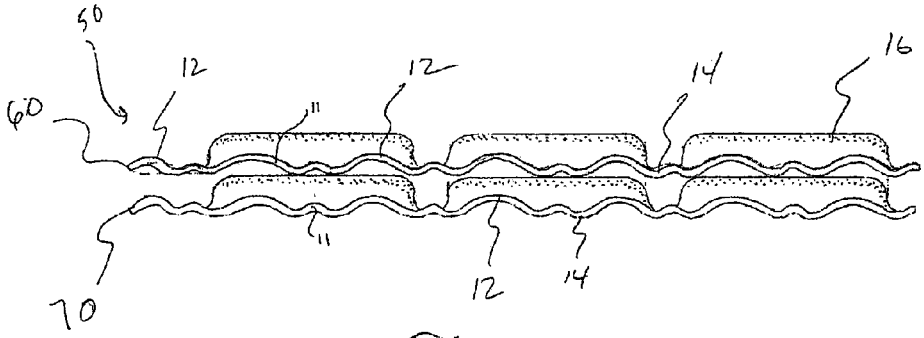
FIG. 2 is a cross-sectional view of the paper web of FIG. 1 taken along a line 2—2.

Although not required, in some embodiments, the transfer fabric 17 is a patterned fabric having protrusions or impression knuckles, such as described in U.S. Pat. No. 6,017,417 to Wendt et al. For instance, a patterned transfer fabric 17 can have protrusions that cause the fibrous web 11 to be imparted with ridges and valleys as it is pressed into contact with the transfer fabric 17. Thus, in this manner, at least one surface of the fibrous web 11 is imparted with ridges 12 and valleys 14 as shown in FIGS. 1–2.

For example, a patterned transfer fabric 17 can generally have any pattern desired. For instance, the protrusions of the fabric 17 may, in some embodiments, have a pitch depth greater than about 0.010 millimeters (mm), in some embodiments between about 0.025 to about 2 mm, and in some embodiments, between about 1 to about 1.8 mm; and a pitch width greater than about 0.001 mm, in some embodiments between about 0.005 to about 5 mm, and in some embodiments, between about 0.25 to about 2.5 mm. In some embodiments, the transfer fabric 17 can have a wire-mesh surface, as is well known in the art. For example, in one embodiment, the transfer fabric 17 has a wire-mesh surface where the wire has a diameter of 1.14 millimeters and a "mesh-count" of 8×13. As used herein, the mesh-count refers to the number of open spaces formed per inch by the wire-mesh in a certain direction. Thus, a mesh-count of 8×13, for example, refers to a wire-mesh with 8 spaces in length and 13 spaces in width.

From the transfer fabric 17, the fibrous web 11 is then transferred to the through-air dryer 21, optionally with the aid of a vacuum transfer shoe 42 or roll. The vacuum transfer shoe 42 (negative pressure) can also be supplemented or replaced by the use of positive pressure from the opposite side of the web 11 to blow the web 11 onto the next fabric. The web 11 is typically transferred from the transfer fabric 17 to the through-air dryer 21 at the nip 40 at a solids consistency less than about 60% by weight, and particularly between about 25% to about 50% dry weight.

In some embodiments, the through-air dryer 21 may also be provided with a through-air drying fabric 19. The through-air drying fabric 19 can travel at about the same speed or a different speed relative to the transfer fabric 17. For example, if desired, the through-air drying fabric 19 can run at a slower speed to further enhance stretch. As stated, the through-air drying fabric 19 can be provided with various protrusions or impression knuckles to impart a surface of the fibrous web with ridges and valleys. Some examples of such fabrics are described in U.S. Pat. No. 6,017,417 to Wendt et al. The through-air drying fabric 19 may be woven or nonwoven.

The through-air dryer 21 can then accomplish the removal of moisture from the web 11 by passing air through the web 11 without applying any mechanical pressure. Through-air drying can also increase the bulk and softness of the web 11. In one embodiment, for example, the through-dryer 21 can contain a rotatable, perforated cylinder and a hood 50 for receiving hot air blown through perforations of the cylinder as the through-air drying fabric 19 carries the fibrous web 11 over the upper portion of the cylinder. The heated air is forced through the perforations in the cylinder of the through-air dryer 21 and removes the remaining water from the fibrous web 11. The temperature of the air forced through the fibrous web 11 by the through-air dryer 21 can vary, but is typically from about 250° F. to about 500° F. Besides the through-air dryer 21, other through-air dryers may also be utilized to assist in the drying of the web. It should also be understood that other non-compressive drying methods, such as microwave or infrared heating, can be used. Moreover, if desired, certain compressive heating methods, such as Yankee dryers, may be used as well.

While supported by the through-air drying fabric 19, the web can then be dried to a solids consistency of about 95% or greater by the through-air dryer 21 and thereafter transferred to a carrier fabric 22. The dried web 11 having at least one surface with ridges and valleys is then transported from the carrier fabric 22 to a reel 24, where it is wound. An optional turning roll 26 can be used to facilitate transfer of the web 11 from the carrier fabric 22 to the reel 24.

Figure 5:
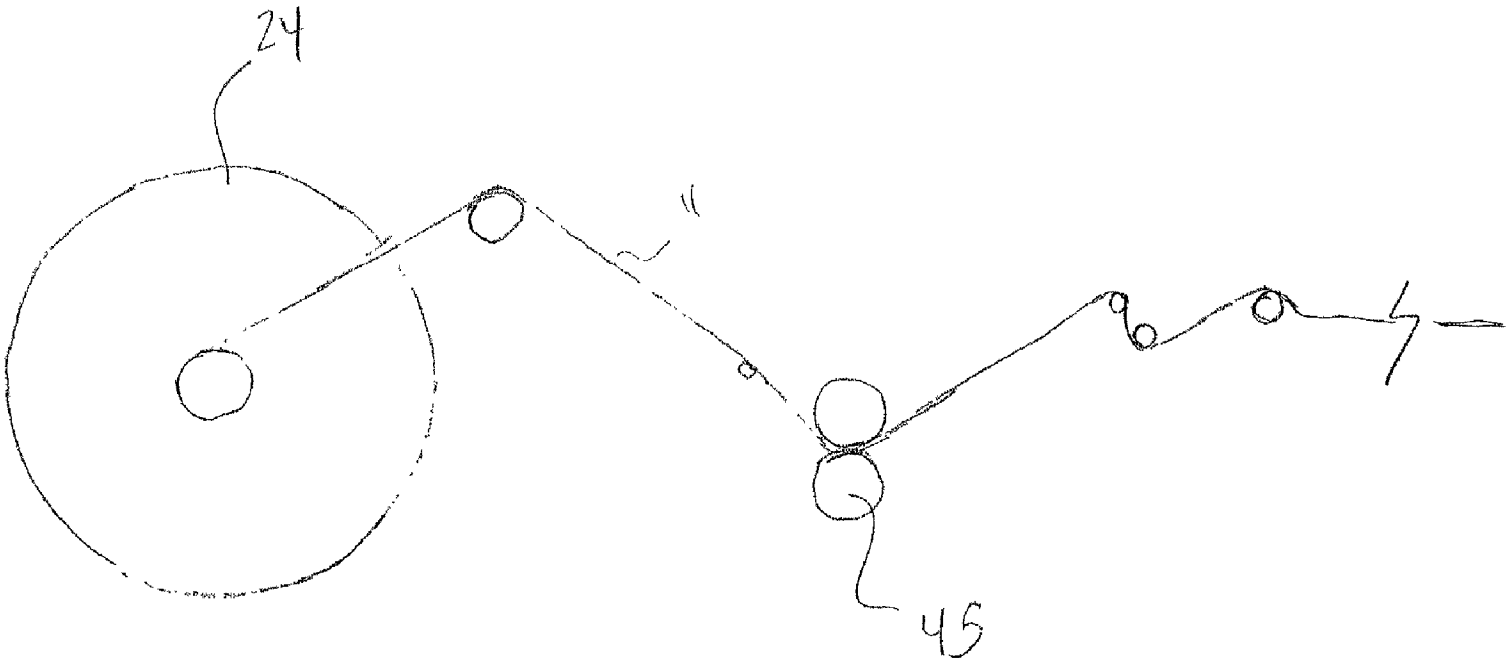
FIG. 5 is a schematic illustration of one embodiment of a converting stage than can be utilized in accordance with the present invention.

Referring to FIG. 5, after being wound on a reel 24, the web 11 can then be transferred to a converting stage in which the web 11 is transferred to smaller rolls or stacks for consumer-sized products. For example, as shown, the web 11 can be initially unwound from the roll 24. Thereafter, the web 11 can be transferred to a rewinder system (not shown) where it is rewound onto smaller rolls.

Referring again to FIG. 1, a papermaking process, such as described above, can impart various ridges 12 and valleys 14 into at least one surface of the fibrous web 11 during formation. For example, in the embodiment described above, the patterned transfer fabric 17 can cause the formation of the ridges 12 and valleys 14, particularly when used in conjunction with the vacuum shoes 18 and/or 20 and textured and/or topographical through-drying fabrics. However, it should be understood that the description provided above is but one embodiment of the present invention, and that the ridges 12 and valleys 14 may be imparted into the web 11 in any manner desired. In fact, the present invention is not limited to any particular mechanism for forming the ridges 12 and valleys 14 into a surface of the web 11.

Moreover, although illustrated herein as being formed in one or more continuous row, it should be understood that the ridges 12 and valleys 14 can generally have any shape, size, or pattern, so long as the mating of such ridges 12 and valleys 14 can cause at least some "nesting".

Figure 3:
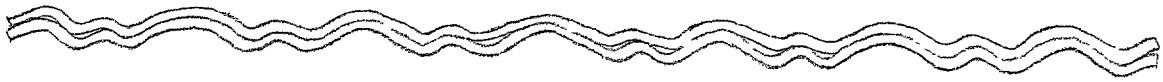
PRIOR ART Fig. 3
FIG. 3 is a cross-sectional view of a prior art paper web that contains nested ridges and valleys.

Thus, regardless of the mechanism utilized to form ridges 12 and valleys 14 into a surface of the web 11, one or more "bridging regions" 16 are imparted into at least one surface of the web 11 to inhibit "nesting" caused by the mating of ridges 12 and valleys 14 between two or more layers of the paper product. As used herein, a "bridging region" is defined as a region of a paper web that at least partially overlaps the peaks of at least two ridges. For example, as shown in FIG. 2, each bridging region 16 overlaps the peaks of three ridges 12. By overlapping the peaks of at least two ridges 12, the bridging regions 16 can inhibit nesting by obstructing at least a portion of the ridges 12 and valleys 14 of one paper layer from mating with at least a portion of the ridges 12 and valleys 14 of another paper layer in such a manner as shown in FIG. 3.

In general, various properties of the bridging regions 16 can be varied, such as, but not limited to, the shape, size, orientation, pattern, etc., of the bridging regions 16. For example, the bridging regions 16 may possess the shape of a square, rectangle, circle, oval, dot, triangle, decorative patterns, etc., and may also have various regular or irregular shapes as well. Moreover, as stated, the dimensions of the bridging regions 16 can also vary. For example, as stated above, the bridging regions 16 are typically relatively long so that they can extend across the peaks of at least two ridges 12. Thus, in one embodiment, such long bridging regions 16 have a length of from about 0.125 inches to about 3 inches, in some embodiments from about 0.25 inches to about 3 inches, and in some embodiments, from about 0.375 to about 1.5 inches. In addition, the bridging regions 16 can also have a relatively small depth. For instance, in some embodiments, the bridging regions 16 can have a depth from about 0.02 to about 0.12 inches, and in some embodiments, from about 0.045 to about 0.06 inches. Further, the length-to-depth ratio of the bridging regions 16 can also vary. For instance, in some embodiments, the bridging regions 16 have a length-to-depth ratio of from about 1:1 to about 150:1, and in some embodiments from about 5:1 to about 40:1. Moreover, in one embodiment, the width of the bridging regions 16 can be about 0.030 inches.

In addition to having a particular size and/or shape, the orientation of the bridging regions 16 relative to the ridges 12 and/or valleys 14 can also be varied. For instance, the bridging regions 16 can be positioned at an angle $\alpha$ between about 0° to about 180° relative to the ridges 12 and valleys 14. This is shown, for example, in FIG. 1, where in one embodiment, broken line 17 (which extends along a longitudinal axis of a row of ridges 12 and/or valleys 14) and line 19 (which is parallel to the longitudinal axis of a bridging region 16) form an angle $\alpha$ of approximately a 90° to better inhibit nesting.

Moreover, the pattern that the bridging regions 16 are spaced about the web 11 can also be varied (e.g., density, spacing distance, etc.). For example, the density of the bridging regions 16 can be varied to provide a relatively large or relatively small number of bridging regions 16 on the web 11. Moreover, the spacing of the bridging regions 16 can also be varied. In one embodiment, for example, the bridging regions 16 can be arranged in spaced apart rows. For example, in one embodiment, the rows of bridging regions 16 can be spaced apart to form a single arc. In another embodiment, as shown in FIG. 1, diagonal rows 28 of bridging regions 16 can be arranged at an angle $\beta$ of approximately 45° relative to the ridges 12 and/or valleys 14. This is shown, for example, in FIG. 1, where in one embodiment broken line 27 (which extends along a longitudinal axis of a row of ridges 12 and/or valleys 14) and line 29 (which extends through the center of each bridging region 16 in a diagonal row 28 of bridging regions 16) form an angle $\beta$ of approximately 45°. In addition, the distance between spaced apart rows and/or between the bridging regions 16 within a single row can also be varied. For example, in the embodiment shown in FIG. 1, the diagonal rows 28 are spaced apart approximately 1 inch. In one embodiment, for example, the bridging regions 16 can possess a certain density and spacing distance so that they form a two-dimensional sinusoidal pattern on the surface of the web 11.

It should also be understood that the shape, size, or orientation of one bridging region 16 can be the same or different than another bridging region 16. Moreover, some bridging regions 16 may form a certain pattern and be spaced apart a certain distance, while other bridging regions 16 may form a different pattern and be spaced apart a different distance.

In general, the bridging regions 16 can be imparted into a surface of the paper web 11 in a variety of ways utilizing a variety of different techniques. For instance, referring again to FIG. 4, one embodiment of the present invention for imparting bridging regions 16 into a surface of the web 11 is illustrated. Specifically, in this embodiment, two rotatable embossing rolls 45 can be utilized to emboss the dried web 11 prior to being wound on the roll 24. Moreover, in another embodiment, as shown in FIG. 5, the embossing rolls 45 can be utilized to emboss the web 11 after it is unwound from the roll 24. It should be understood that the embossing rolls 45 can be utilized at multiple positions, as well as additional other positions not specifically mentioned herein. Furthermore, in some embodiments, a single rotatable embossing roll 45 can also be utilized against a moving resilient or hard surface, such as a moving belt, etc. In fact, any embossing method known in the art can be utilized in the present invention.

The embossing rolls 45 can be made from any of a variety of materials, such as of steel, aluminum, magnesium, brass, rubber, hard urethane, or combinations thereof. The embossing roll(s) 45 generally presses the web 11 at a certain pressure. For instance, in some embodiments, a roll pressure of from about 25 pounds per liner inch (PLI) to about 300 PLI can be utilized. Moreover, the embossing roll(s) 45 can also be heated or cooled if desired.

In accordance with one embodiment of the present invention, the surface of the embossing roll 45 can contain a certain number of embossing elements (not shown) that are configured to be placed into communication with the surface of the fibrous web 11 to form the bridging regions 16. For instance, when the patterned surface of the embossing rolls 45 press against the surface of the web 11, the shape, size, orientation, and pattern of the embossing elements are thereby imparted into the fibrous web 11. The resulting shape, size, orientation, and pattern left by the embossing elements of the embossing roll 45 define the bridging regions 16 described above. Thus, although not required, the shape, size, orientation, and pattern of the embossing elements, in this embodiment, are typically identical to or at least substantially similar to the shape, size, orientation, and pattern of the bridging regions 16, such as set forth above.

As stated above, the paper web 11 can be formed into a paper product in a variety of ways. For instance, in some embodiments, the paper web 11, either alone or in conjunction with other paper webs, can be wound into a roll or stacked (continuous or discontinuous layers). As shown in FIGS. 1–2, in one embodiment, the paper product 50 contains two continuous stacked layers 60 and 70. In this embodiment, each layer 60 and 70 are formed from the fibrous web 11 and, as shown, also contain an outer surface that defines ridges and valleys 12 and 14 and bridging regions 16. It should also be understood, however, that the layers 60 and 70 need not both contain the same fibrous web 11, but can also be formed from different fibrous webs that may or may not be formed in the same manner as the fibrous web 11. Moreover, the layers 60 and/or 70 may also contain other webs in conjunction with the fibrous web 11.

The present invention may be better understood with reference to the following examples.

EXAMPLE 1

A finished product sheet was made as described above and shown in FIGS. 4 and 5. Specifically, a non-layered basesheet was made in which the furnish was comprised of 75% of LL-19 softwood pulp fibers and 25% of bleached chemical thermomechanical (BCTMP) softwood pulp fibers. The sheet was formed on a forming fabric having a ridge spacing of approximately 0.125 inches. The sheet was then subjected to steel-on-rubber cross-directional bar embossing with an embossing roll at 75 pounds per linear inch. Once embossed, the sheet was dried and wound onto cores to form rolls of paper towels.

Figure 6:
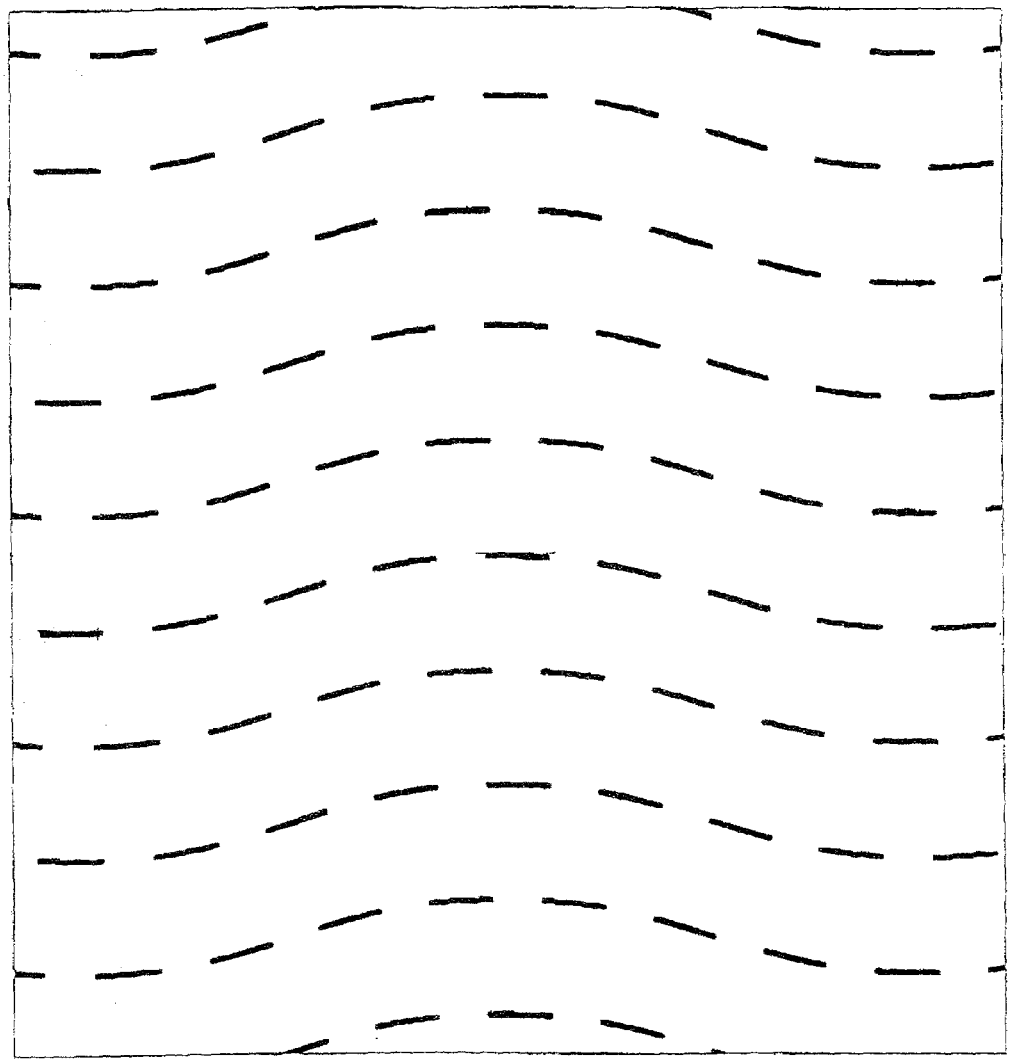
FIG. 6 illustrates an embossing pattern that can be used in one embodiment of the present invention.

The embossing pattern utilized is shown in FIG. 6 and included embossing elements having the following dimensions:

| | |
|---|---|
| Length: | 0.40625" |
| Width: | 0.030" |
| Height: | 0.045" |
| Area per element: | 0.0121875 $in^2$ |
| 9 elements in 6.5 cross directional inches | |
| 0.75 inches between rows of emboss | |
| % area of emboss: | 2.7% |

A product using the same sheet described above was also prepared for comparison, but rather than being embossed, was steel-on-steel calendered at a 0.005 inch gap prior to winding. Rolls were also formed using the second sheet.

Various properties of the different products were then tested. Specifically, the initial caliper of the sheet (before winding) was compared to the final caliper of the sheet (after winding). In addition, the average roll diameter and roll firmness were also determined.

Figure 9:
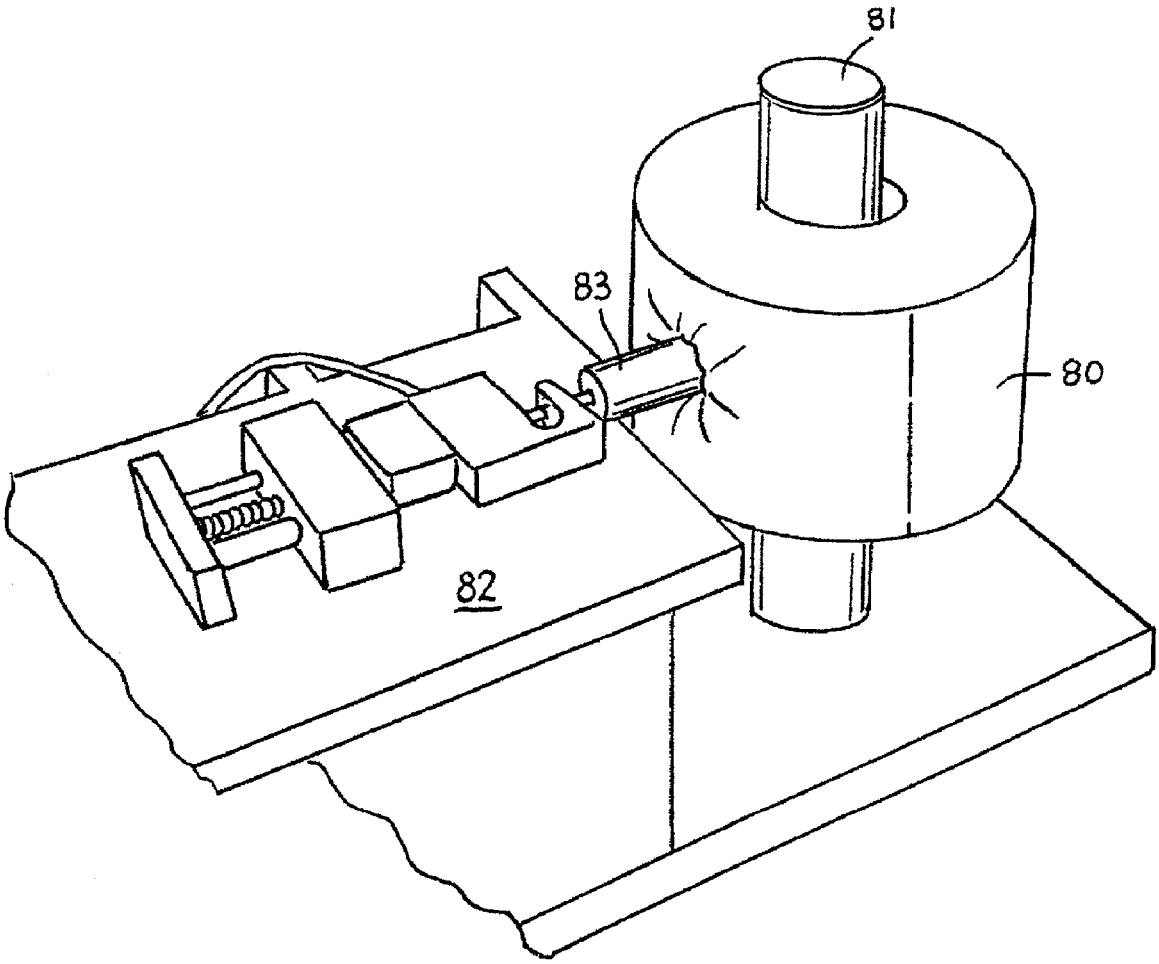
FIG. 9 illustrates the apparatus utilized in the examples to measure roll firmness.

"Roll firmness" was determined using a Model RDT-101 Roll Density Tester from Kershaw Instrumentation, Inc., Swedesboro, N.J. For instance, the apparatus utilized to measure roll firmness is illustrated in FIG. 9. As shown, a towel roll 80 being measured is supported on a spindle 81. When the test begins, a traverse table 82 begins to move toward the roll. Mounted to the traverse table is a sensing probe 83. The motion of the traverse table causes the sensing probe to make contact with the towel roll. The instant the sensing probe contacts the roll, the force exerted on the load cell will exceed the low set point of 6 grams and the displacement display will be zeroed and begin indicating the penetration of the probe. When the force exerted on the sensing probe exceeds the high set point of 687 grams, the traverse table will stop and the displacement display will indicate the penetration in millimeters. The tester will record this reading. Next the tester will rotate the towel roll 90° on the spindle and repeat the test. The roll firmness value is the average of the two readings. The test is performed in a controlled environment of 73.4° F.±1.8° F. and 50%±2% relative humidity. The rolls to be tested are introduced to this environment at least 4 hours before testing. The method for determining roll firmness is also described in U.S. Pat. No. 6,077,590 to Archer, et al., which is incorporated herein in its entirety by reference thereto for all purposes.

The results are summarized below in Table 1:

TABLE 1

| Sample Characteristics | | | | |
|---|---|---|---|---|
| Sample | Initial Caliper (inches) | Final Caliper (inches) | Roll Firmness (mm) | Average Roll Diameter (mm) |
| Embossed | 0.033 | 0.0269 | 7.2 | 5.08 |
| Calendered | 0.033 | 0.0267 | 7.8 | 5.11 |

In addition, five random rolls of paper towels from each product were analyzed to determine the percent of wraps nested in the roll. The "% of wraps nested" was determined according to the following formula:

% of wraps nested=([1−(# total wraps in roll−# total wraps nested)/# total wraps in roll]×100)

Figure 10:
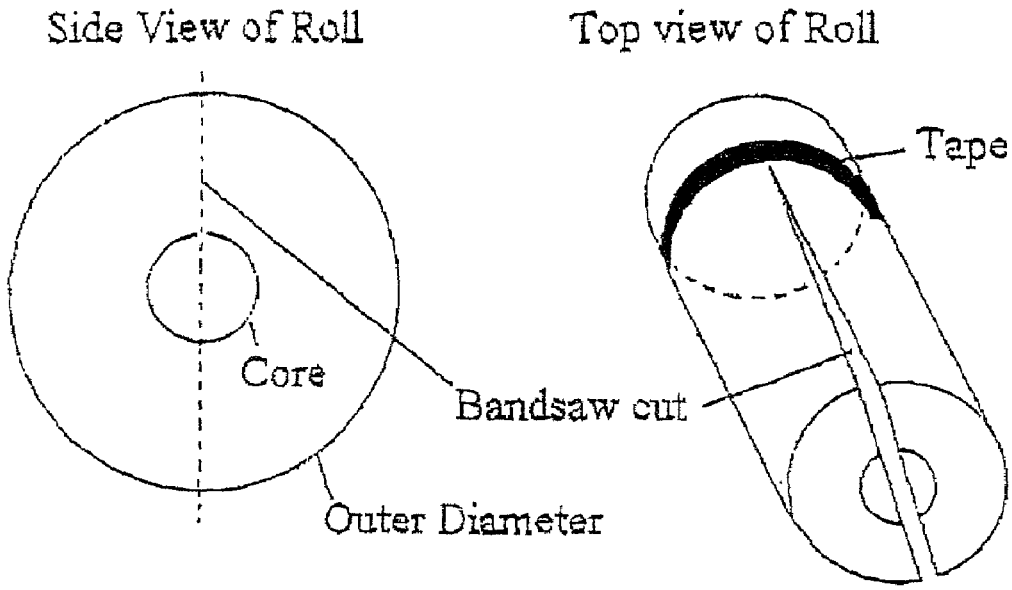
FIGS. 10–11 illustrate the method utilized in the examples for determining the number of wraps nested in a roll.
Figure 11:
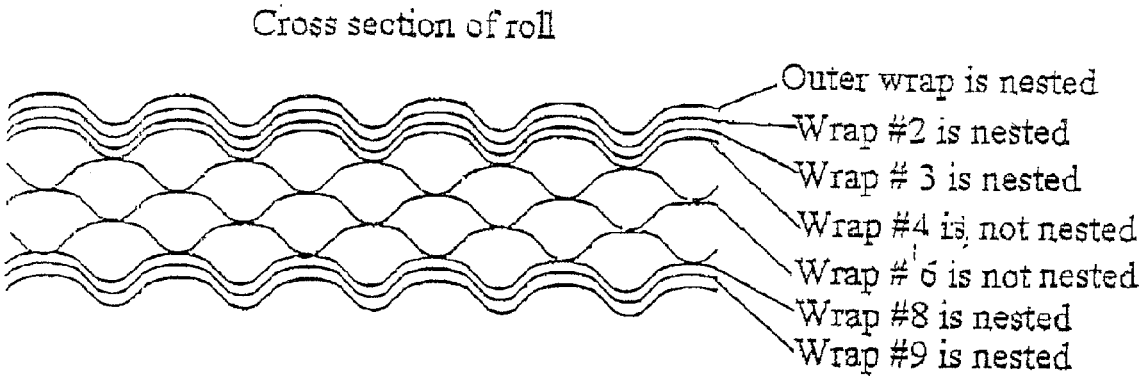

The # wraps nested was determined by cutting a roll with a known number of wraps radially in the cross section, as shown in FIG. 10. Before being cut, the roll is wrapped with at least 1 strip of masking tape about ¼ length into the roll to hold the roll together during and after cutting. Once cut, an expert examines the roll to determine the number of wraps that are nested. A wrap is considered nested if its valleys lie within the valleys of the next wrap, such as shown in FIG. 11.

The results are summarized below in Table 2.

TABLE 2

| Sample Characteristics | | | |
|---|---|---|---|
| Embossed | | Calendered | |
| Sample number | % of wraps nested | Roll number | % of wraps nested |
| 1 | 38% | 6 | 62% |
| 2 | 19% | 7 | 51% |
| 3 | 19% | 8 | 48% |
| 4 | 29% | 9 | 61% |
| 5 | 29% | 10 | 61% |
| | Average 27% | | Average 57% |

Table 3 shows the results of the same samples summarized in Table 2, but with the first 15 wraps of each roll eliminated from the total count of the # of wraps.

TABLE 3

| Sample Characteristics | | | |
|---|---|---|---|
| Embossed | | Calendered | |
| Sample number | % of wraps nested | Sample number | % of wraps nested |
| 1 | 15% | 6 | 60% |
| 2 | 7% | 7 | 43% |

TABLE 3-continued

| Sample Characteristics | | | |
|---|---|---|---|
| Embossed | | Calendered | |
| Sample number | % of wraps nested | Sample number | % of wraps nested |
| 3 | 6% | 8 | 46% |
| 4 | 17% | 9 | 54% |
| 5 | 22% | 10 | 57% |
| | Average 13% | | Average 52% |

As indicated by Tables 1–3, the non-embossed (calendered) rolls generally exhibited more nesting than the embossed rolls. Moreover, as indicated by the results in Table 3, more nesting appeared to occur near the end of the wind. Thus, by removing the first 15 wraps from the rolls, the level of nesting could be decreased.

EXAMPLE 2

Three sets of paper towel rolls were formed. The first two sets of rolls were formed as described in Example 1, and included both embossed and calendered rolls.

The third set of rolls were non-layered single-ply towels made in from a furnish comprised of 75% LL-19 softwood pulp fibers and 25% bleached chemical thermomechanical (BCTMP) softwood pulp fibers. The sheet was formed on a forming fabric having a ridge spacing of approximately 0.2 inches. The sheet had a significantly greater amount of cross-direction ridges than the sheet formed in Example 1. Once embossed, the web was dried and wound onto a standard roll to form the final product. The third set of rolls was steel-on-steel calendered at a gap of 0.003 inches prior to winding. Comparison of five rolls for each condition is summarized below in Table 4. Roll firmness and the % of wraps nested were determined as set forth in Example 1.

TABLE 4

| Sample Characteristics | | | |
|---|---|---|---|
| | % wraps nested | Roll Firmness (mm) | Diameter of roll |
| Embossed | 19 | 6.4 | 5.04 |
| | 19 | 6.9 | 5.15 |
| | 29 | 6.9 | 5.08 |
| | 29 | 7.2 | 5.10 |
| | 38 | 7.3 | 5.15 |
| Non-embossed (1st set) | 48 | 7.2 | 5.13 |
| | 51 | 8.0 | 5.10 |
| | 61 | 8.2 | 5.10 |
| | 61 | 9.5 | 5.10 |
| | 62 | 8.8 | 5.10 |
| Non-embossed (2nd set) | 14 | 5.9 | 5.07 |
| | 19 | 7.1 | 5.10 |
| | 35 | 6.9 | 5.10 |
| | 35 | 7.3 | 5.09 |
| | 17 | 6.4 | 5.10 |

EXAMPLE 3

Figure 7:
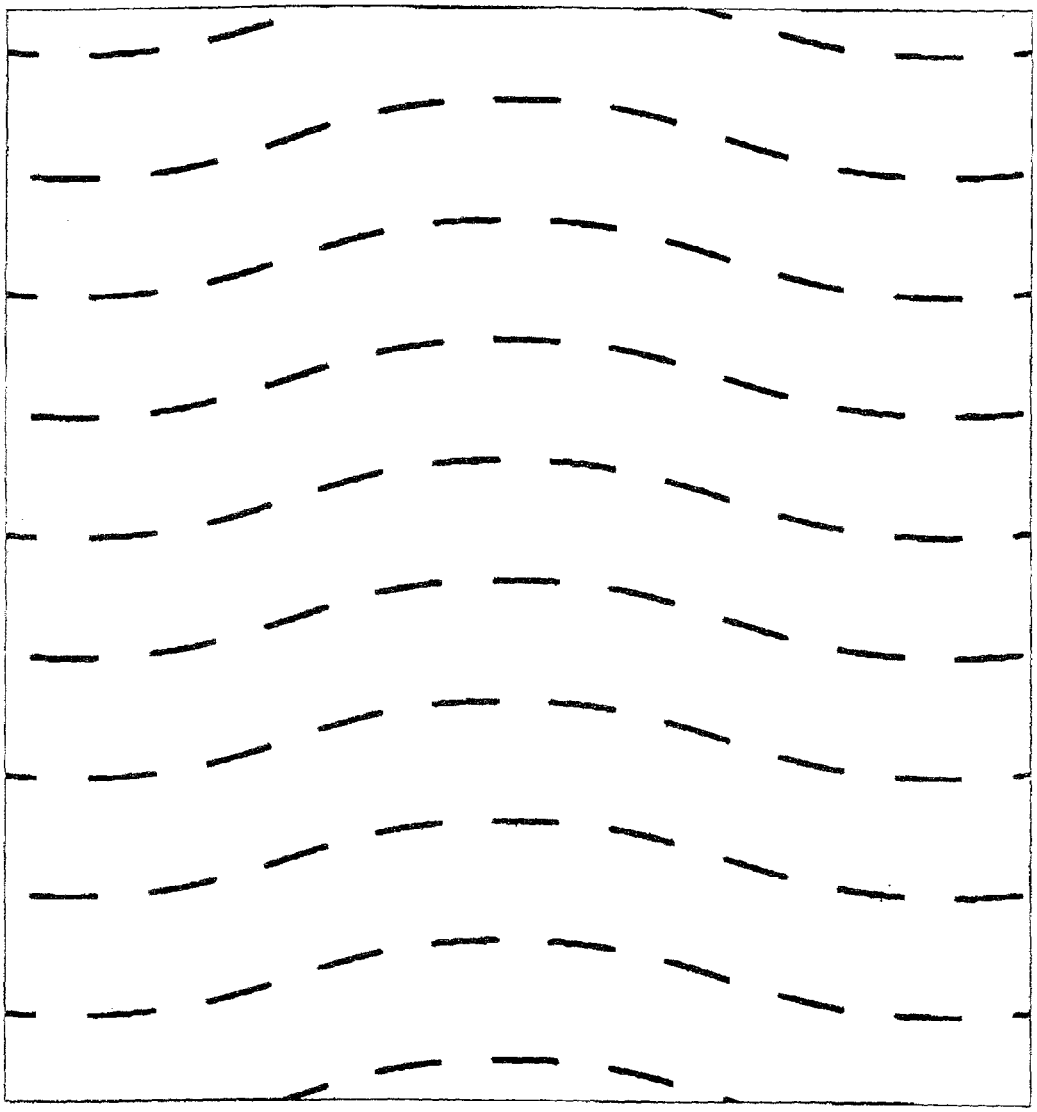
FIG. 7 illustrates another embossing pattern that can be used in one embodiment of the present invention.

A first basesheet was described above and shown in FIGS. 4 and 5. Specifically, a non-layered basesheet was made in which the furnish was comprised of 75% of LL-19 softwood pulp fibers and 25% of bleached chemical thermomechanical (BCTMP) softwood pulp fibers. The basesheet was formed on a forming fabric having a ridge spacing of approximately 0.125 inches. The basesheet was then subjected to cross-directional bar embossing roll at various pressures. The embossing pattern utilized is shown in FIG. 7 and included embossing elements having the following dimensions:

| | |
|---|---|
| Length: | 0.4375" |
| Width: | 0.030" |
| Height: | 0.060" |
| Area per element: | 0.118125 $in^2$ |
| 9 elements in 6.5 cross directional inches | |
| 0.75 inches between rows of embossing elements | |
| % area of emboss: | 2.4% |

A second basesheet (Sample B) was also made as described above and shown in FIGS. 4 and 5. Specifically, a non-layered basesheet was made in which the furnish was comprised of 75% of LL-19 softwood pulp fibers and 25% of bleached chemical thermomechanical (BCTMP) softwood pulp fibers. The basesheet was formed on a forming fabric having a ridge spacing of approximately 0.2 inches. The basesheet was then subjected to cross-directional bar embossing with an embossing roll at various pressures. Once embossed, the basesheet was wound onto to form rolls of paper towels. For purposes of comparison, various samples of this basesheet were also steel-on-steel calendered at various gaps prior to winding.

Various properties of the different basesheets were then tested. Specifically, the initial caliper and firmness of the basesheets (before winding) were compared to the caliper and firmness of the basesheets after 30–60 minutes. Moreover, roll firmness were determined as set forth in Example 1.

The results are summarized below in Table 5:

TABLE 5

| Sample Characteristics | | | | |
|---|---|---|---|---|
| Basesheet | Initial Firmness | Firmness 30–60 min. after initial | Initial Caliper | Final Caliper 30–60 min. after initial |
| Sample A (embossed, 150 pli) | 10–11 mm | 9.5 mm | 0.024"–0.026" | 0.025" |
| Sample A (embossed, 50 pli) | 7.5–8.5 mm | 6.5 mm | 0.0275" | 0.0283" |
| Sample A (S/S cal., 0.055" gap) | 7.5–8.5 mm | 5.8 mm | 0.0275" | 0.0292" |
| Sample B (embossed, 200 pli) | 8.5–9.0 mm | 7.59 mm | 0.027" | 0.028" |
| Sample B (S/S cal., 0.004" gap) | 8.0 mm | 6.0 mm | 0.027" | 0.029" |

EXAMPLE 4

Various basesheets were prepared and formed into rolls. Specifically, five samples of a first basesheet (Sample A) were made as described above and shown in FIGS. 4 and 5. Specifically, a non-layered basesheet was made in which the furnish was comprised of 75% of LL-19 softwood pulp fibers and 25% of bleached chemical thermomechanical (BCTMP) softwood pulp fibers. The basesheet was formed on a forming fabric having a ridge spacing of approximately 0.125 inches. The basesheet was then subjected to cross-directional bar embossing with an embossing roll at various pressures.

Figure 8:
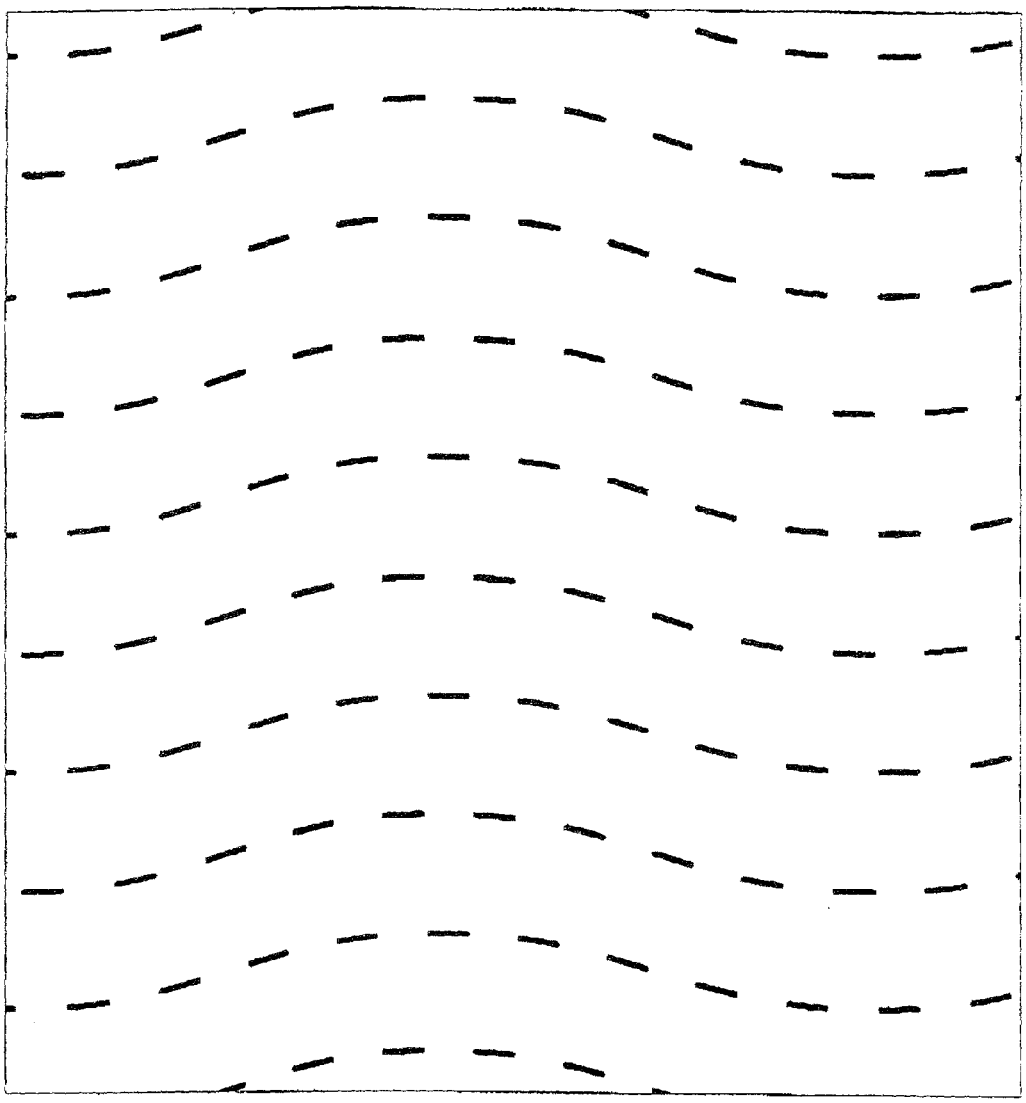
FIG. 8 illustrates still another embossing pattern that can be used in one embodiment of the present invention.

The embossing patterns utilized for the first base sheet are shown in FIGS. 6–8, and have the following dimensions:

| Embossing Pattern #1 (FIG. 6) | |
|---|---|
| Length: | 0.4375" |
| Width: | 0.030" |
| Height: | 0.060" |
| Area per element: | 0.118125 $in^2$ |
| 9 elements in 6.5 cross directional inches | |
| 0.75 inches between rows of embossing elements | |
| % area of emboss: | 2.4% |
| **Embossing Pattern #2 (FIG. 7)** | |
| Length: | 0.40625" |
| Width: | 0.030" |
| Height: | 0.045" |
| Area per element: | 0.0121875 $in^2$ |
| 9 elements in 6.5 cross directional inches | |
| 0.75 inches between rows of emboss | |
| % area of emboss: | 2.7% |
| **Embossing Pattern #3 (FIG. 8)** | |
| Length: | 0.25" |
| Width: | 0.030" |
| Height: | 0.060" |
| Area per element: | 0.0075 $in^2$ |
| 11 elements in 6.5 cross directional inches | |
| 0.75 inches between rows of emboss | |
| % area of emboss: | 1.7% |

A second basesheet (Sample B) was also made as described above and shown in FIGS. 4 and 5. Specifically, a non-layered basesheet was made in which the furnish was comprised of 75% of LL-19 softwood pulp fibers and 25% of bleached chemical thermomechanical (BCTMP) softwood pulp fibers. The basesheet was formed on a forming fabric having a ridge spacing of approximately 0.2 inches. The basesheet was then subjected to cross-directional bar embossing with an embossing roll at various pressures with the embossing patterns set forth above. Once embossed, the basesheet was wound onto to form rolls of paper towels.

For purposes of comparison, various samples of the basesheets (Samples A and B) were also steel-on-steel calendered at various gaps prior to winding.

Various properties of the different basesheets were then tested. Specifically, the initial caliper and firmness of the basesheets (before winding) were compared to the caliper and firmness of the final basesheets. Roll firmness was determined as set forth in Example 1.

The results are summarized below in Table 6.

TABLE 6

| | Sample Characteristics | | | |
|---|---|---|---|---|
| Sample | Basesheet Caliper (inches) | Product Caliper (inches) | Avg. Firmness (mm) | Avg. Diameter (inches) |
| Sample A Pattern #1 150 pli | 0.0323 | 0.025 | 9.5 | 5.18 |
| Sample A Pattern #1 50 pli | 0.0323 | 0.0283 | 6.5 | 5.05 |

TABLE 6-continued

| | Sample Characteristics | | | |
|---|---|---|---|---|
| Sample | Basesheet Caliper (inches) | Product Caliper (inches) | Avg. Firmness (mm) | Avg. Diameter (inches) |
| Sample A Pattern #2 100 pli | 0.0306 | 0.0259 | 8.6 | 5.10 |
| Sample A Pattern #2 50 pli | 0.0323 | 0.0298 | 6.7 | 5.10 |
| Sample A Pattern #2 75 pli | 0.0330 | 0.0269 | 7.2 | 5.08 |
| Sample A Pattern #3 200 pli | 0.0323 | 0.0268 | 9.2 | 5.10 |
| Sample A Non-embossed S/S 0.0055" | 0.0323 | 0.0292 | 5.8 | 5.05 |
| Sample A Non-embossed S/S 0.0050" | 0.0330 | 0.0267 | 7.8 | 5.11 |
| Sample B Pattern #1 200 pli | 0.0374 | 0.028 | 7.6 | 5.09 |
| Sample B Pattern #1 200 pli | 0.0376 | 0.028 | 7.1 | — |
| Sample B Pattern #2 200 pli | 0.0376 | 0.0269 | 7.9 | 5.10 |
| Sample B Pattern #2 200 pli | 0.0376 | 0.0266 | 10.5 | 5.10 |
| Sample B Pattern #3 200 pli | 0.0383 | 0.0277 | 7.5 | 5.08 |
| Sample B Non-embossed S/S 0.004" | 0.0374 | 0.029 | 6.0 | 5.11 |
| Sample B Non-embossed S/S 0.003" | 0.0376 | 0.0283 | 6.6 | 5.08 |

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A wound or stacked product comprising:

a plurality of paper sheet layers wound or stacked to form the product, each paper sheet layer having an exterior surface that defines ridges and valleys oriented in a first direction, wherein each said paper sheet layer comprises a multi-ply paper sheet or a single-ply paper sheet, wherein said paper sheet layers are positioned adjacent to each other when stacked or wound such that said ridges and valleys of each paper sheet layer are substantially parallel to said ridges and valleys of adjacent paper sheet layers when wound or stacked; and bridging regions formed into each said exterior surface of said paper sheet layers such that said bridging regions extend outward from said exterior surface, said bridging regions having a length sufficient to extend across at least two of said ridges, said bridging regions having a length-to-depth ratio of from about 5:1 to about 40:1, said bridging regions at least partially obstructing said ridges and valleys of said surface of each paper sheet layer from mating with said ridges and valleys of said surface of adjacent paper sheet layers to inhibit nesting between each paper sheet layer when stacked or wound into the product.

2. A wound or stacked product as in claim 1, wherein said bridging regions are spaced apart in rows on said surface of each paper sheet layer.

3. A wound or stacked product as in claim 2, wherein said rows of spaced apart bridging ridges on said surface of each paper sheet layer are arranged at an angle of about 45° to said direction of said ridges.

4. A wound or stacked product as in claim 1, wherein the length of said bridging regions is substantially greater than the width of said bridging regions.

5. A wound or stacked product as in claim 1, wherein the length of said bridging regions is from about 0.125 inches to about 3 inches.

6. A wound or stacked product as in claim 1, wherein the length of said bridging regions is from about 0.375 inches to about 1.5 inches.

7. A wound or stacked product as in claim 1, wherein said bridging regions have a depth of from about 0.012 inches to about 0.12 inches.

8. A wound or stacked product as in claim 1, wherein said bridging regions have a depth of from about 0.045 inches to about 0.06 inches.

9. A wound or stacked product as in claim 1, wherein the length of said bridging regions extends in a direction about 90° relative to said ridges.

10. A wound or stacked product as in claim 1, wherein said plurality of paper sheet layers form a continuous paper product that is wound on a roll.

11. A wound or stacked product as in claim 1, wherein said paper sheet layers are individually stacked.

12. A wound or stacked product as in claim 1, wherein said paper sheet layers comprise single-ply paper sheets.

13. A wound or stacked product as in claim 1, wherein said paper sheet layers comprise multi-ply paper sheets.

14. A wound or stacked product as in claim 1, wherein said paper sheet layers comprise through-dried paper webs.

15. A wound or stacked product as in claim 1, wherein said paper sheet layers comprise uncreped through-air dried paper webs.

16. A wound or stacked product as in claim 1, wherein the basis weight of each said paper sheet layer is less than 140 grams per square meter.

17. A wound or stacked product as in claim 1, wherein the basis weight of each said paper sheet is from about 10 grams per square meter to about 70 grams per square meter.

18. A wound or stacked product as in claim 1, wherein said ridges and valleys of each paper sheet layer are in substantially parallel continuous rows.

19. A wound or stacked product as in claim 1, wherein said bridging regions form a two-dimensional sinusoidal pattern.

20. A method comprising:

forming a paper web from a furnish containing cellulosic fibers, said paper web having an exterior surface that defines ridges and valleys oriented in a first direction;

drying said paper web with a through-dryer;

embossing said paper web to form bridging regions into said surface of said paper web, said bridging regions having a length sufficient to extend between at least two of said ridges defined by said surface of said paper web, said bridging regions having a length-to-depth ratio of from about 5:1 to about 40:1, said bridging regions extending outward from said exterior surface of said paper web; and forming a wound or stacked paper product comprising a plurality of paper sheet layers from said paper web, wherein each said paper sheet layer comprises a multi-ply paper web or a single-ply paper web, each said paper sheet layer being positioned adjacent to another paper sheet layer when wound or stacked to form the product such that said bridging regions at least partially obstruct said ridges and valleys of each said paper sheet layer from mating with said ridges and valleys of an adjacent paper sheet layer to inhibit nesting between each said paper sheet layer when wound or stacked into the paper product.

21. A method as in claim 20, wherein said paper web is dried prior to the formation of said bridging regions.

22. A method as in claim 20, wherein said embossing is accomplished with at least one roll having embossing elements in a certain pattern, said bridging regions having a pattern that corresponds to the pattern of said embossing elements.

23. A method as in claim 22, wherein said roll applies a pressure of from about 25 pounds per linear inch to about 300 pounds per linear inch to said paper web.

24. A method as in claim 22, wherein said roll is formed from steel, aluminum, magnesium, brass, rubber, hard urethane, or combinations thereof.

25. A method as in claim 20, wherein said bridging regions are arranged in spaced apart rows.

26. A method as in claim 20, wherein the length of said bridging regions is substantially greater than the width of said bridging regions.

27. A method as in claim 20, wherein the length of said bridging regions is from about 0.125 inches to about 3 inches.

28. A method as in claim 20, wherein the length of said bridging regions is from about 0.375 inches to about 1.5 inches.

29. A method as in claim 20, wherein said bridging regions have a depth of from about 0.012 inches to about 0.12 inches.

30. A method as in claim 20, wherein said bridging regions have a depth of from about 0.045 inches to about 0.06 inches.

31. A method as in claim 20, wherein each said paper sheet layer forms a continuous paper web wound on a roll.

32. A method as in claim 20, wherein each said paper sheet layer is individually stacked.

33. A method as in claim 20, wherein each said paper sheet is layer comprises a single-ply paper sheet.

34. A method as in claim 20, wherein each said paper sheet is layer comprises a multi-ply paper sheet.

35. A wound paper product comprising:

a continuous paper sheet forming a plurality of paper sheet layers when wound into the paper product, said continuous paper sheet having an exterior surface that defines ridges and valleys oriented in a first direction, wherein said continuous paper sheet is wound such that said ridges and valleys of each said paper sheet layer are substantially parallel to said ridges and valleys of adjacent paper sheet layers; and bridging regions formed into said exterior surface of said continuous paper sheet, said bridging regions extending outward from said exterior surface of said continuous paper sheet, said bridging regions having a length sufficient to extend across at least two of said ridges, said bridging regions having a length-to-depth ratio of from about 5:1 to about 40:1, said bridging regions at least partially obstructing said ridges and valleys of said surface of each paper sheet layer from mating with said ridges and valleys of said surface of adjacent paper sheet layers to inhibit nesting between each paper sheet layer when said continuous paper sheet is wound into the product.

36. A wound paper product as in claim 35, wherein said continuous paper sheet is a single-ply paper sheet.

37. A wound paper product as in claim 35, wherein said continuous paper sheet is a multi-ply paper sheet.

* * * * *